US005882266A

United States Patent [19]

Schaum

[11] Patent Number: 5,882,266

[45] Date of Patent: Mar. 16, 1999

[54] GOLF TRAINING DEVICE

[76] Inventor: Eduard Carl Schaum, P.O. Box 5264, Newport Beach, Calif. 92662

[21] Appl. No.: 961,042

[22] Filed: Oct. 30, 1997

[51] Int. Cl.[6] ..... A63B 69/36

[52] U.S. Cl. ..... 473/220; 473/240; 362/259

[58] Field of Search ..... 473/220, 240, 473/237; 362/259

[56] References Cited

U.S. PATENT DOCUMENTS

| | | | |
|---|---|---|---|
| 3,507,500 | 4/1970 | Scott | 473/240 X |
| 5,725,440 | 3/1998 | Finney | 473/220 |
| 5,788,588 | 8/1998 | Hooker | 473/220 X |

*Primary Examiner*—George J. Marlo

[57] ABSTRACT

A golf training device which clamps onto the shaft of a standard golf club. The device has a holding block which holds a laser pointing in a downward direction. A hinged mirror at the light emitting end of the laser causes the laser light to be reflected at roughly a ninety degree angle and thereby run parallel to the ground. An alignment strip and separate target helps the user calibrate the training device so that the laser beam is perpendicular to the flat head striking area of the golf club. The alignment strip can then be removed allowing the user to move the target to any reasonable distance. In this way a golfer can learn the proper alignment of club head to hole thereby improving his or her ability to accurately putt a golf ball towards and into the hole. The hinged mirror on the training device of the present invention can also be swung down so that the laser light is pointing straight down. In this orientation a user can swing a golf club in a practice room and observe the swing path of the club as the laser light forms a line as it strikes the floor, wall and ceiling. The training device of the present invention is easily attached and removed and is compact enough to be carried in ones pocket.

7 Claims, 4 Drawing Sheets

GOLF TRAINING DEVICE

BACKGROUND OF THE INVENTION

The present invention relates to golf training devices and more specifically to a golf-training device, which removably attaches to a golf club and helps teach proper club alignment and resulting swing.

Many golf training devices are available in the market today. Golfers are always interested in improving their score. Since more than forty percent of the strokes in a typical round of golf are made with the putter, it behooves the golfer to improve alignment and accuracy when putting the ball towards the hole. The present device provides a unique way to do just that.

OBJECTS AND SUMMARY OF THE PRESENT INVENTION

It is an object of the present invention to provide an improved golf training device to train a golfer to aim a golf ball more accurately toward the hole while putting. It is another object of the present invention to provide a golf training device which will also enable a golfer to visually check the path of swing of the club. It is a further object of the present invention to provide a golf training device which can be easily installed and removed from a golf club. Still a further object of the present invention to provide a golf training device which can be easily calibrated. A further object of the present invention is to provide a golf training device which is easy and economical to manufacture. The above objects are implemented by providing a holding block which can be fastened to a golf club without the use of special tools. The holding block holds a small helium neon laser which is in a parallel relationship to the shaft of the golf club. A mirror located below the light emitting end of the laser reflects the light at a ninety degree angle so the light is parallel to the ground. An alignment strip and target card enables the user to calibrate the laser so that the dot which the laser projects is at right angles to, and in alignment with the center of the flat hitting portion of the club head. The alignment strip can be removed and the user can then use the dot on the target card or a dot on any vertical surface such as a wall to act as an a target for the laser dot. The user can then grip the club and place the center of the striking surface a short distance behind the golf ball. By alternately removing and returning the club head to the hitting position several times, the user can feel and see the correct positioning of hands and club head for hitting the ball to a desired spot, in this case the spot on the target or the wall. The user can then actually hit the ball and see the ball hit the target After several practice sessions the user can achieve more accurate club head-target alignment even after the training device has been removed from the club.

The mirror at the bottom of the laser is hinged and can be swung down and out of the way of the laser beam thereby causing the laser beam to point straight down. In this position a person can swing a club and see the line created by the moving dot projected by the laser beam as the laser light strikes the floor, walls and ceiling of the practice room. Of course the ceiling of the practice room must be sufficiently high to allow for a full swing.

GENERAL DESCRIPTION OF THE DRAWINGS

DETAILED DESCRIPTION OF THE DRAWINGS

Figure 1:
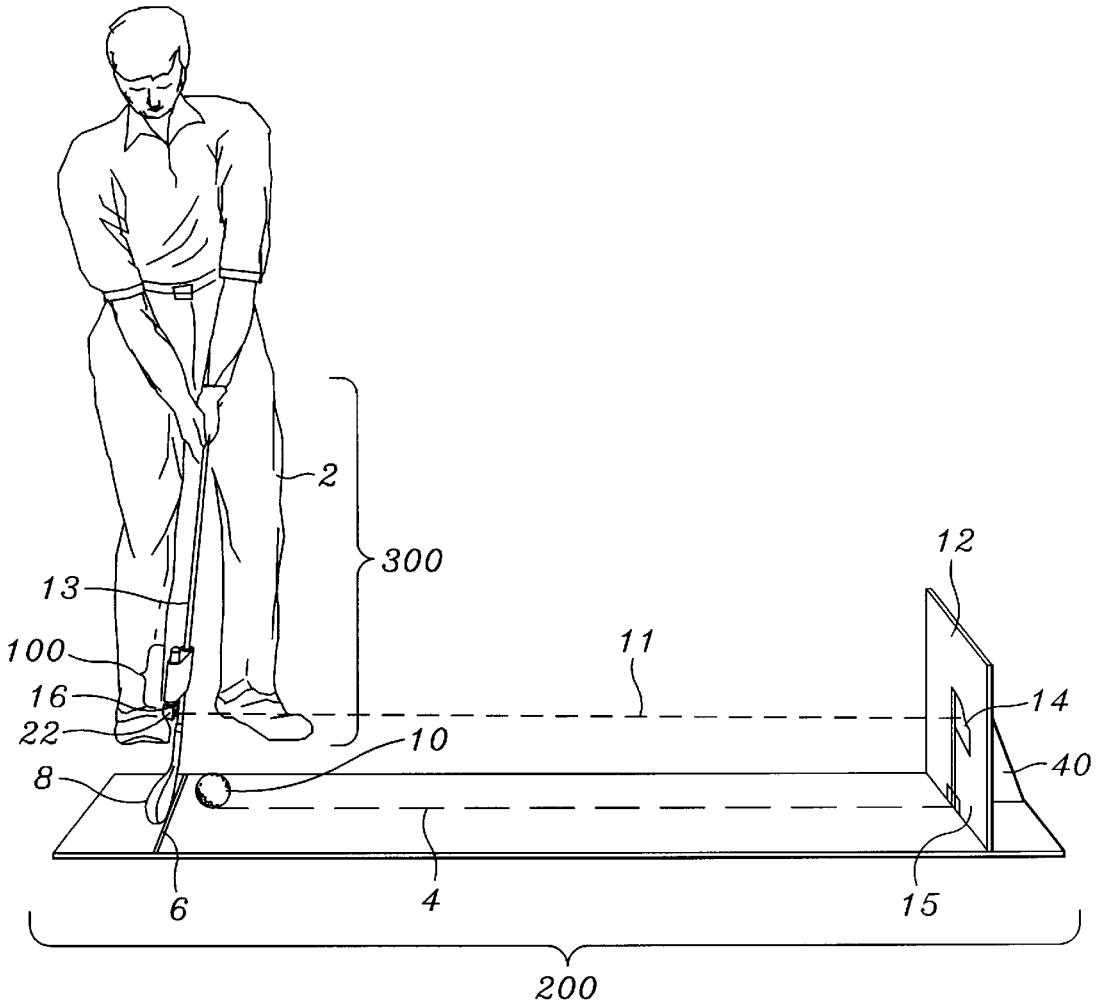
FIG. 1 is a perspective view of a golfer using the training device of the present invention.
Figure 2:
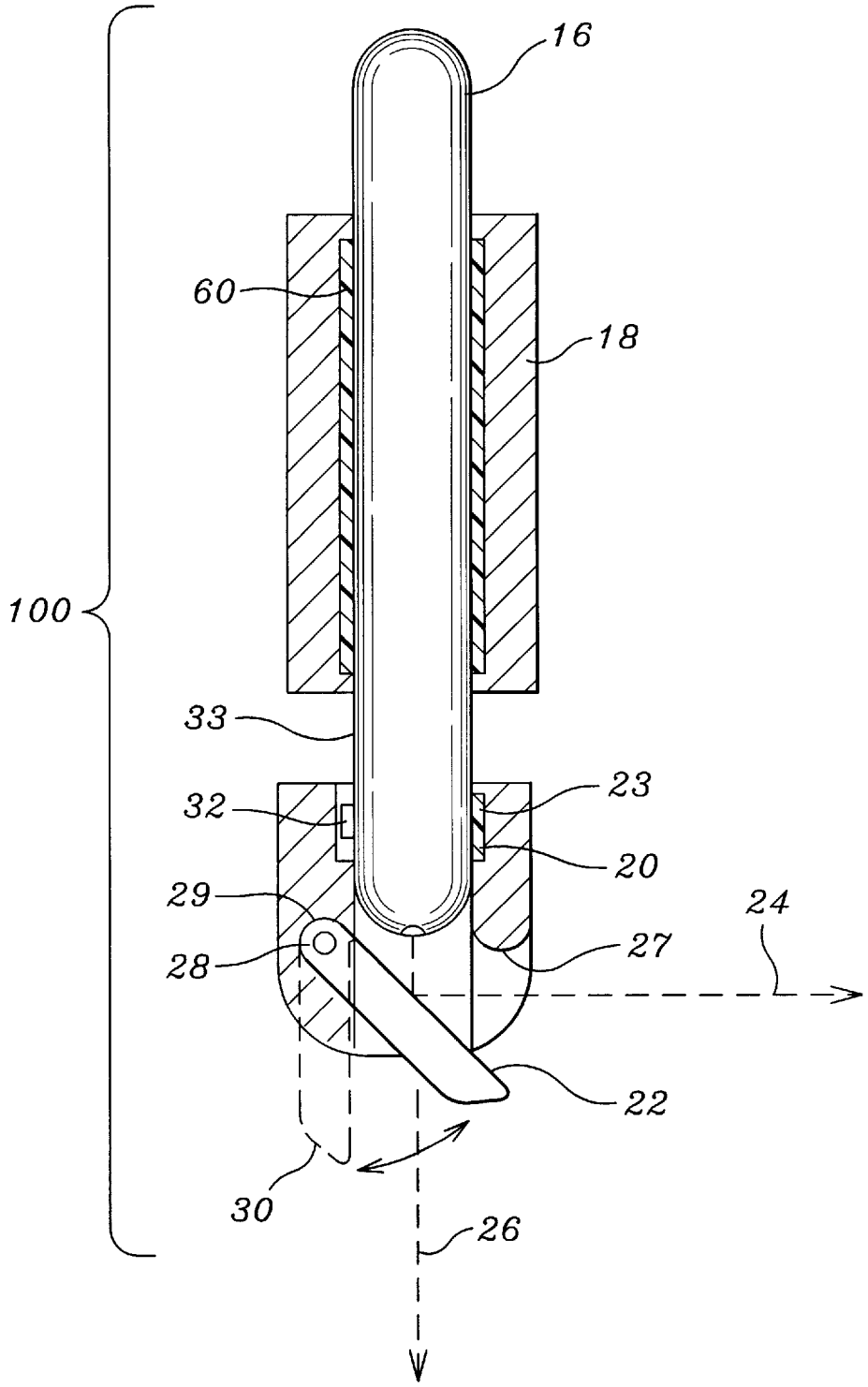
FIG. 2 is a side section view of the golf training device of the present invention.
Figure 3:
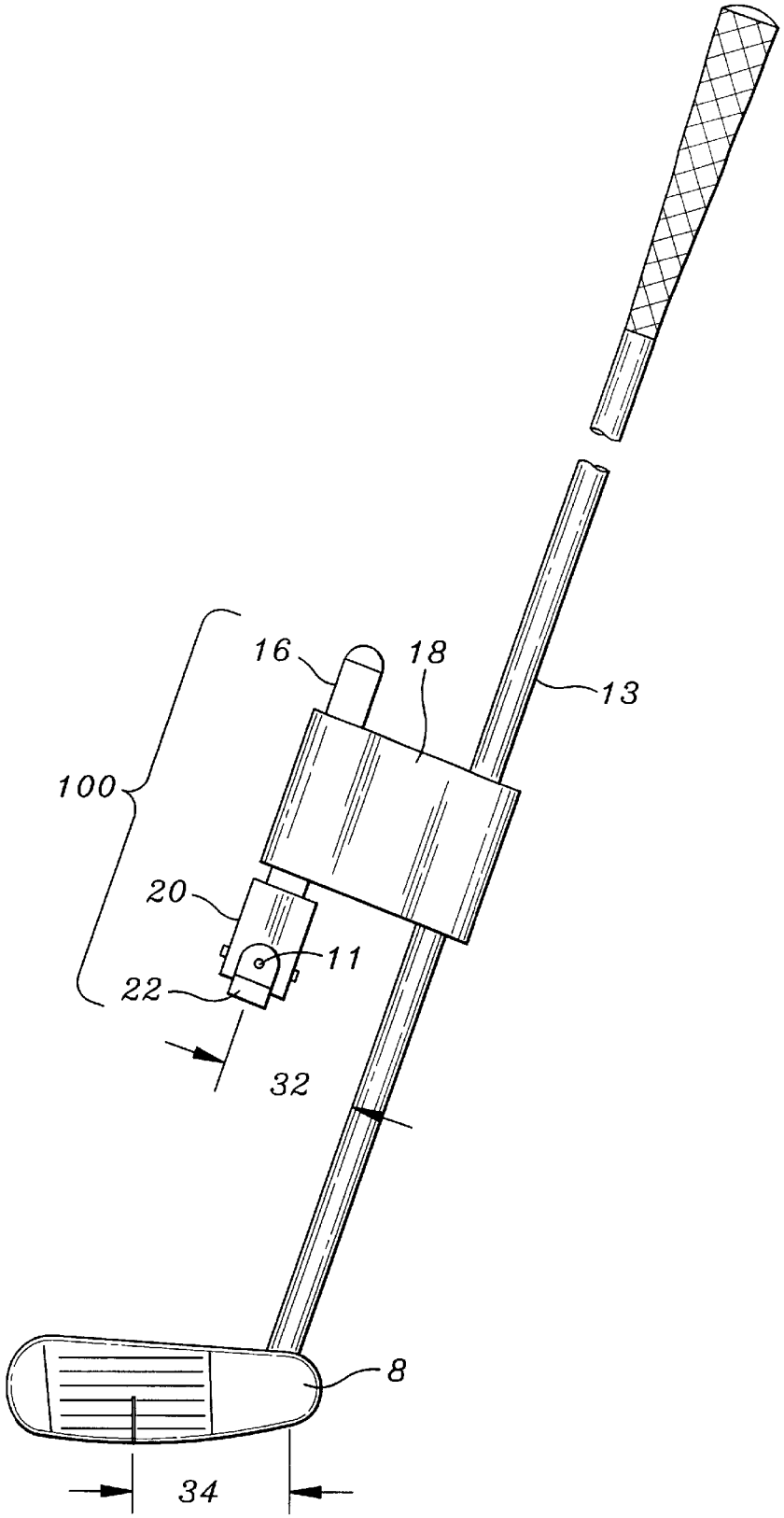
FIG. 3 is a side view of the present invention attached to a golf club.
Figure 4:
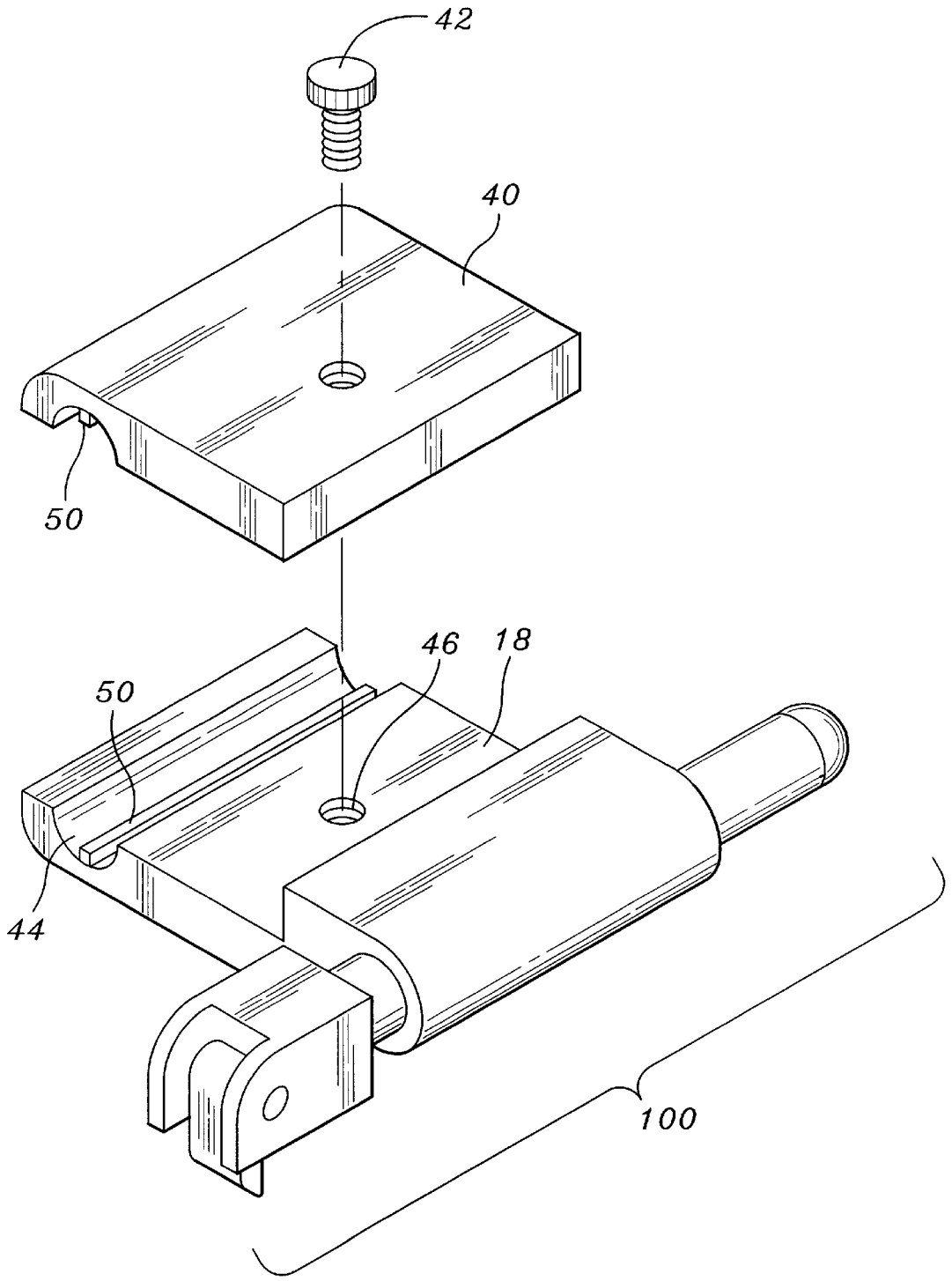
FIG. 4 is an exploded view of the golf training device of the present invention showing the clamping mechanism.

Referring now to FIG. 1 we see a person 2 gripping a golf club 300. The golf training device of the present invention 100 is attached to the golf club 300. A laser 16 mounted in the training device 100 emits a downward pointing laser light which is then reflected by mirror 22 causing the laser light to go in a direction parallel to the ground 11. To calibrate the training device 100 the user places an alignment strip 200 on the ground. The strip 200 has a line 6 running parallel to the left short edge of the alignment strip 200 and a second line 4 running centrally down the length of the alignment strip and perpendicular to line 6. A target card 12 is placed on the alignment strip so that the vertical line 15 on the alignment card lines up with the central line 4 on the alignment strip. The user then rotates the training device 100 around the shaft 13 so that when the striking surface is placed on and parallel to line 6, the point where the laser light strikes the mirror 22 is directly above line 4 as well as the striking point of impact on surface 8. The user then rotates the collar 20 so that the reflected laser light strikes the spot 14 located on line 15 at the center of the target card. At this point the training device 100 is calibrated. The user 2 can then remove the alignment strip 200 and simply aim the laser beam at the target card or at a spot on a wall or other vertical surface. The user can now feel and see the proper orientation of the golf club head as it relates to hitting a ball to a desired location. The user can actually hit a ball and see it land at the laser spot, assuming that the golf club head has not been twisted during the swing. FIG. 2 shows a section view of the golf training device of the present invention 100. Laser 16 is held by holding block 18. Laser 16 is similar to standard pointer type lasers that are used for pointing when giving office presentations or the like. Resilient strips 60 cause a frictional fit which allows the laser to be twisted and remains in place after adjustment. Collar 20 holds hinged mirror 22. Mirror 22 can be set at a forty-five degree angle causing laser light 24 to progress in a horizontal direction. Resilient strip 23 causes a frictional fit which allows collar 20 to be twisted and to remain in place after adjustment. When mirror 22 is rotated downward as shown in dotted line 30 the laser beam progresses in a downward direction. In this mode the user can attach the training device 100 to a golf club and see a laser line as the club is swung in a practice room thereby allowing the user to observe the swing path of the club. Ramp 32 located inside collar 20 is aligned with an on-off button 33 on the laser. When collar 20 is raised it causes the on-off button to be depressed which turns on laser 16. When collar 20 is pulled down, button 33 is released causing laser 16 to turn off. Mirror 22 is a front surface mirror so that a double reflection of the laser light is avoided. Mirror 22 is stopped at the proper angle by ledge 27 on collar 20. Hinge pin 28 has a frictional fit with surrounding hinge enclosure 29 so that mirror 22 stays in place when moved from one position to the other. FIG. 3 shows a front view of the golf-training device 100 of the present invention while mounted on a golf club. Holding block 18 attaches to golf club shaft 13 so that laser 16 is parallel to shaft 13. Positioning of the laser 16 in this orientation affords a compact configuration which can be more easily carried when not in use and which looks less obtrusive when in use. Laser 16 is held away from golf club shaft 13 by about two inches 32 so that laser light 11 is aligned with the center of club head 8 as shown in dimension 34. FIG. 4 shows the attachment means for fastening the training device of the present invention 100 to a golf club. Retaining plate 40 is screwed onto main holding block 18 by a thumb screw 42 which is received by threaded hole 46. Resilient strips 50 act to hold a golf club shaft securely yet allow the device 100 to be moved up or down or twisted and to remain in place once so positioned. The thumb screw type attachment 42 allows the user to quickly and easily attach or remove the device 100 with out the need for special tools.

Therefore we see that the present invention is a unique and valuable training device which can help a golfer to improve the accuracy of his or her putting activity or full swing activity. The device is easy to install and remove and is easy to calibrate. The device is compact and easy to transport in one's pocket.

Although the above drawings and description of the drawings are a preferred embodiment, it is to be understood that there may be other embodiments of the present invention which fall within the spirit and scope of the claims of the present invention and which would be obvious to one versed in the art of golf training devices.

Therefore I claim:

1. A golf training device designed to be mounted onto the shaft of a standard golf club comprised of a rigid holding block, a standard helium neon laser, a hinged mirror, a mirror retaining collar, a holding block retaining plate, an alignment strip and a target;

said rigid holding block being essentially rectangular in shape and having said laser imbedded along one edge of the holding block and a crescent shaped trough running parallel to and approximately two inches away from said laser, said retaining plate having a matching crescent shaped trough capable of capturing the shaft of a standard golf club between said holding block and said retaining plate, said removable retaining plate affixed to said holding plate by a thumb screw running through said retaining plate and entering a threaded hole in said holding block, said mirror retaining collar slidably held onto the lower, light emitting portion of said laser, said mirror being hinged at one end and capable of being set at a forty five degree angle or being set parallel to said laser.

2. A golf training device as recited in claim 1 wherein said holding block and said mirror retaining collar have between their laser adjoining surfaces resilient strips allowing said laser or said holding block to be twisted or slid up and down and remain in place once adjusted.

3. A golf training device as recited in claim 1 wherein said alignment strip has printed on its surface a line for aligning the face of a golf club and a perpendicular line for calibrating the proper orientation of said training device, said target being adapted to placed on said alignment strip and having a vertical line for alignment with said perpendicular line on said alignment strip, said target also having a spot printed centrally at which the user aims the laser beam.

4. A golf training device as recited in claim 1 wherein said alignment strip is moveable and said target is adapted to be set at any reasonable distance from said golf club.

5. A golf training device as claimed in claim 1 wherein said mirror can be swung down thereby allowing said laser beam to point in a direction parallel to the shaft of said golf club thereby allowing a user to swing said golf club and to observe a laser line as said laser beam strikes the floor, walls and ceiling of a room.

6. A golf training device of claim 1 wherein said training device is compact in design and can be carried on the user's pocket.

7. A golf training device of claim 1 wherein said training device can fit onto most standard golf clubs.

* * * * *